United States Patent [19]

Fenwick

[11] 4,381,876

[45] May 3, 1983

[54] FRONT LIGHTED DISPLAY CASE

[75] Inventor: Jay G. Fenwick, Albert Lea, Minn.

[73] Assignee: Litton Business Systems Inc., Albert Lea, Minn.

[21] Appl. No.: 207,531

[22] Filed: Nov. 17, 1980

[51] Int. Cl.[3] ..... A47B 47/00; F16B 12/00

[52] U.S. Cl. ..... 312/114; 312/137; 312/140.4; 312/111

[58] Field of Search ..... 312/137, 111, 140.1, 312/140.2, 140.3, 140.4, 114; 248/206 A

[56] References Cited

U.S. PATENT DOCUMENTS

| | | | |
|---|---|---|---|
| 634,701 | 10/1899 | Petz | 312/114 |
| 845,652 | 2/1907 | La Berge | 312/114 |
| 1,379,554 | 5/1921 | Riefel et al. | 312/137 |
| 2,023,260 | 12/1935 | Beers et al. | 312/114 |
| 2,735,739 | 2/1956 | Patriarca | 312/114 |
| 3,228,736 | 1/1966 | Beckerman | 312/114 |
| 3,346,310 | 10/1967 | Diack | 312/114 |
| 3,574,433 | 4/1971 | Bell | 312/111 |
| 3,998,509 | 12/1976 | Hauser | 312/140.4 |
| 4,211,382 | 7/1980 | Bonfils | 248/206 A |
| 4,326,760 | 4/1982 | Riegelheim et al. | 312/111 |

FOREIGN PATENT DOCUMENTS

| | | | |
|---|---|---|---|
| 91769 | 7/1954 | Netherlands | 312/111 |
| 1015580 | 1/1966 | United Kingdom | 312/111 |

*Primary Examiner*—Victor N. Sakran

*Attorney, Agent, or Firm*—Michael H. Wallach

[57] ABSTRACT

A wood-type front lighted display case is disclosed which can be assembled on-site using preinstalled cam lock fasteners. An extrusion and trim strip therefor hold the front and top glass panels in place, and are configured for easy glass replacement in the event of breakage. The extrusion also functions as a mounting for the light fixture, having an integral wireway.

3 Claims, 8 Drawing Figures

Fig. 4
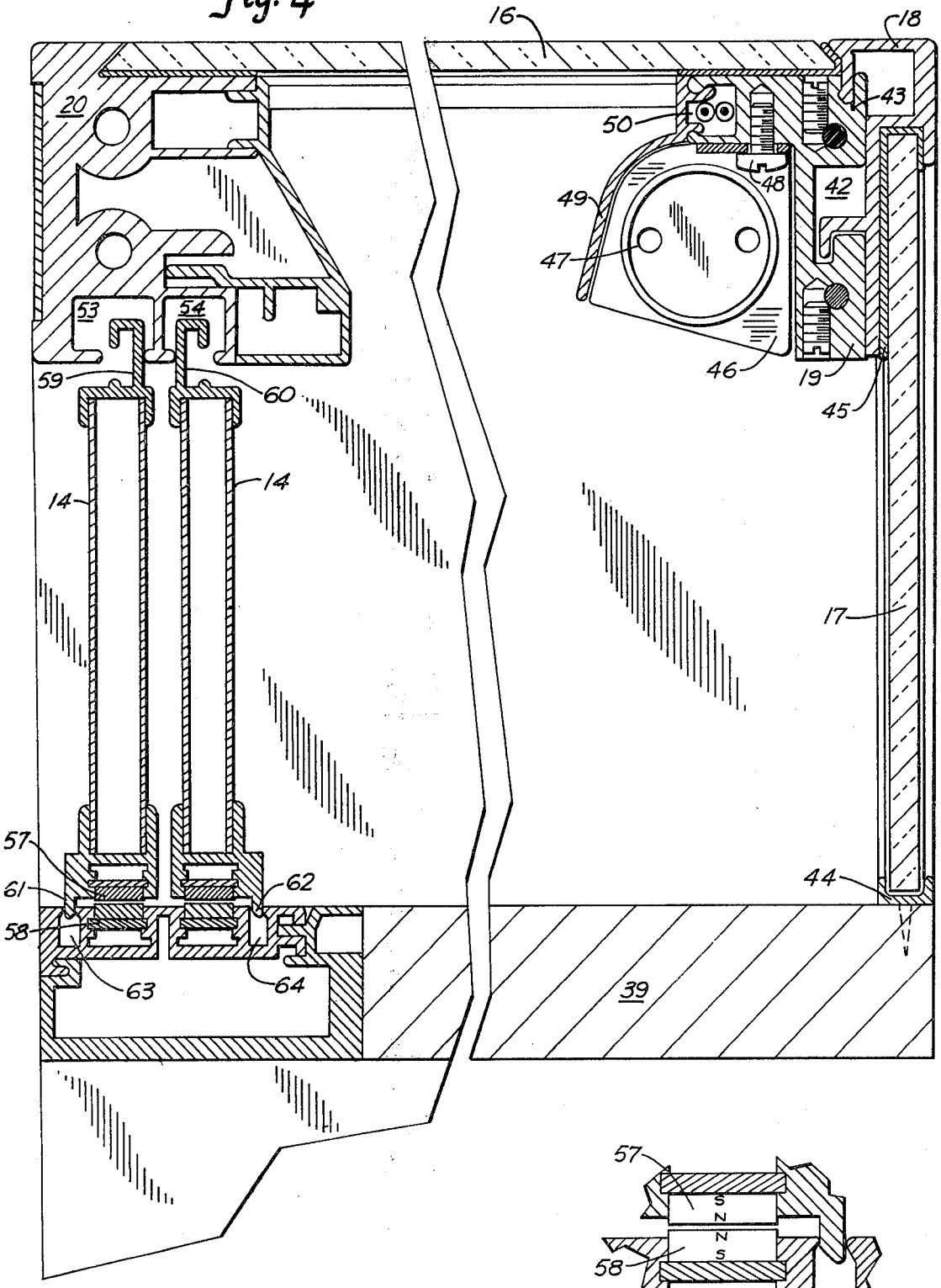
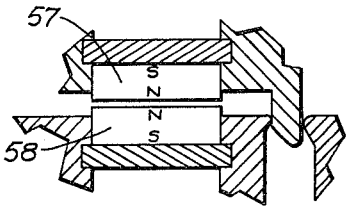
Fig. 8

FRONT LIGHTED DISPLAY CASE

BACKGROUND OF THE INVENTION

This invention relates to display cases for various kinds of merchandise such as jewelry and the like. Such cases are generally made of wood or a wood-like material. They have a glass front and top through which merchandise may be viewed, and the cases typically include some kind of interior lighting.

In the past it has been the practice of the trade to custom build cases of the type to which the invention is directed. The cases were considered articles of furniture and were generally constructed and finished by master cabinetmakers. As a result, the cases were expensive to manufacture and to purchase and were accordingly only used to display merchandise of considerable value.

A distinct disadvantage to the prior art display cases, in addition to initial cost, was the problem of replacement of broken glass. Because of the structure of the case, it was not uncommon to require the return of the entire case to the manufacturer in order to replace the glass. In the alternative, a cabinetmaker was sent to the site to disassemble and rebuild the case to replace the broken glass.

A still further disadvantage of the prior art cases is that they had to be shipped in a fully assembled condition. This required expensive crating and packing. Moreover, the assembled case represented considerable volume to weight and thus high shipping costs.

SUMMARY OF THE INVENTION

It is therefore an object of the present invention to provide a display case which has the appearance of a piece of finished wood furniture and yet may be easily assembled on location.

A further object of the invention is to provide a wood-type display case which provides for the easy replacement of glass panes on site.

A still further object is to provide a display case having a novel lighting apparatus whereby the interior of the case may be lighted by an easily installed fixture which is hidden from view.

The present invention comprises a lighted showcase including a base, side panels, a back and a front, a portion of the front being glass, and a glass top. The base, side panels and front portions are equipped with a plurality of cam lock fasteners which allow the various parts to be assembled without glue or permanent fasteners such as screws or nails. A front rail is mounted between the sides in the upper front corner of the case, the rail having various preformed slots. A trim piece is configured to snap into engagement with the slots, serving both as finishing trim and a mounting piece for the glass front and top pieces. The front rail also includes a U-shaped channel adapted to receive a preformed light reflector, whereby the channel serves both as a mounting slot for the light reflector and as a wireway for the electrical wiring.

DESCRIPTION OF THE DRAWINGS

FIG. 4 is a partial cross-sectional view taken along line 4—4 in FIG. 2.

FIG. 8 is an enlarged view of a portion of FIG. 4 showing the use of magnetic strips for door glides and support.

DESCRIPTION OF PREFERRED EMBODIMENTS

Figure 1:
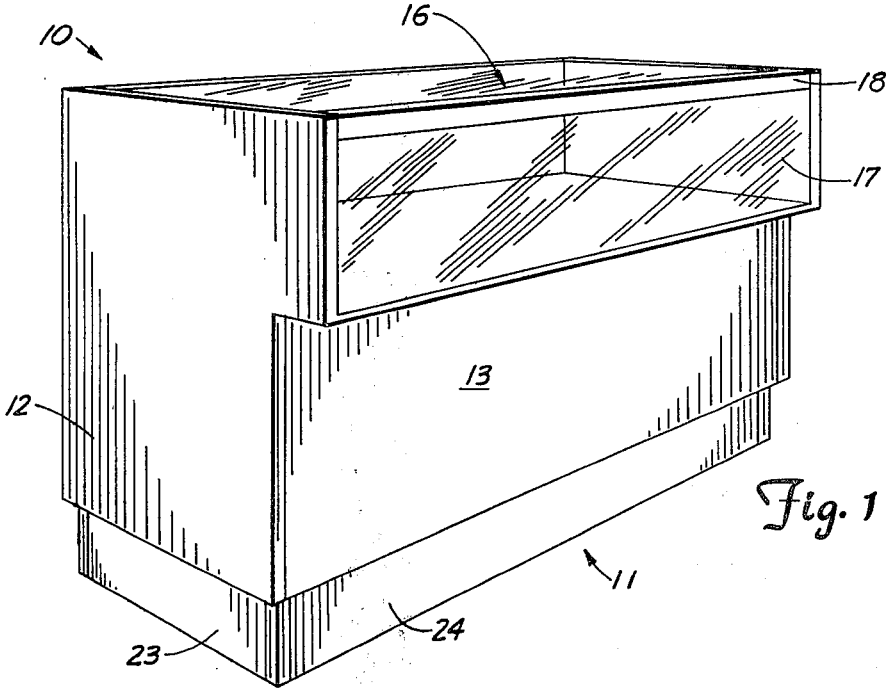
FIG. 1 is a front perspective view of a display case of the type constructed in accordance with the present invention.
Figure 2:
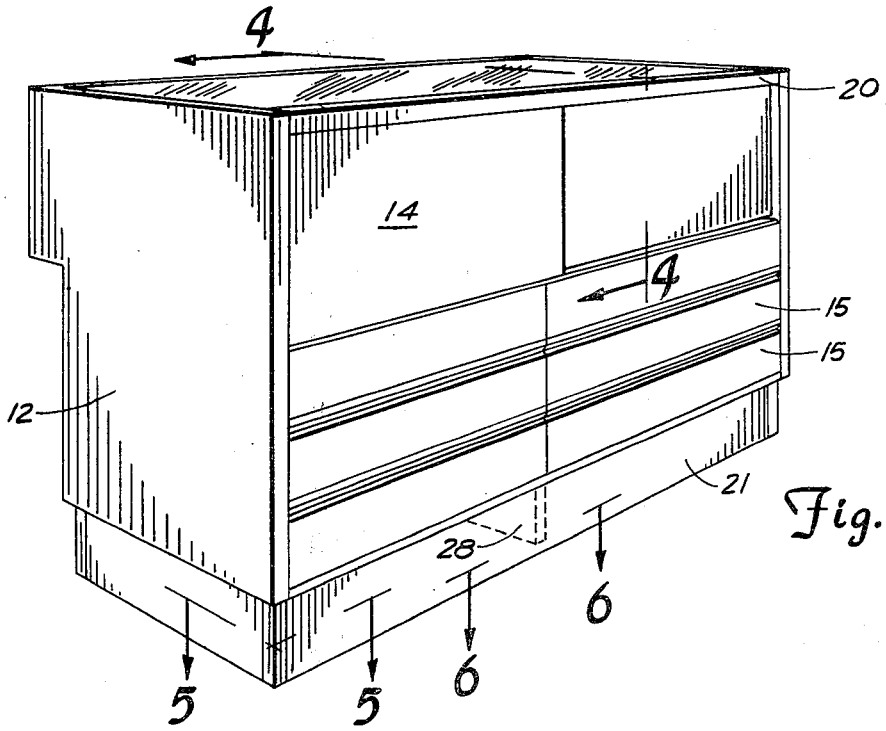
FIG. 2 is a rear perspective view of the display case shown in FIG. 1.

The invention will be described by reference to the drawing figures in which a display case 10 of the type contemplated by the present invention is shown in FIGS. 1 and 2. The case includes a base portion 11, side panels 12, and a generally vertical front portion 13. The front of the case is defined as that side on which a customer viewing merchandise displayed therein would stand, whereas the rear portion is that side on which the sales attendant would be located.

The rear portion of the case may be generally open in construction and typically will include sliding doors 14 and a number of drawers 15. Both the sliding doors 14 and the drawers 15 will typically be equipped with suitable locks so that the case can be secured against unwanted intrusion.

The top of the case is comprised primarily of a single pane of glass 16. The front portion of the case also includes a front glass 17 which extends across a portion of the front height of the case. Both the top glass 16 and the front glass 17 are held in place by a trim member 18 which will be described in greater detail hereinafter. The trim member 18 is in turn secured to a front rail 19, shown best in FIG. 4. Across the rear portion of the case there is provided a rear rail 20 to secure the top glass 16 at that edge.

Figure 5:
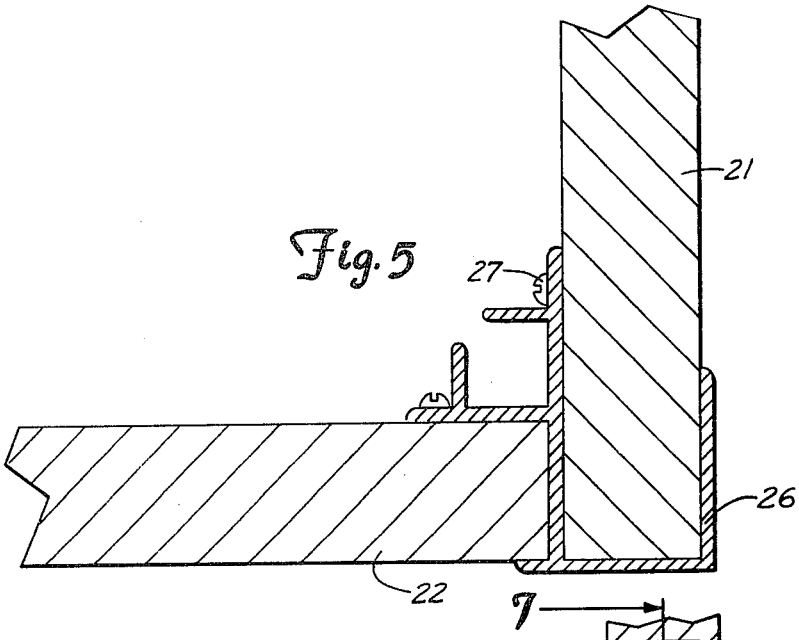
FIG. 5 is an enlarged partial cross-section taken along line 5—5 in FIG. 2.

The base portion 11 of the case is simply constructed from five individual structural members arranged in the form of an open rectangle. Hence four boards or structural members 21, 22, 23, and 24 are arranged in the form of a rectangle with a fifth structural member, center structural member 28 running laterally across the rectangle. Each of the structural members are secured at the corner portions thereof by a corner bracket 26 which is attached to the structural members by means of screws 27. In this manner the base portion 11 is a rigid, permanently fastened structure. The details of construction of the corners of the base portion are shown best in FIG. 5.

Figure 3:
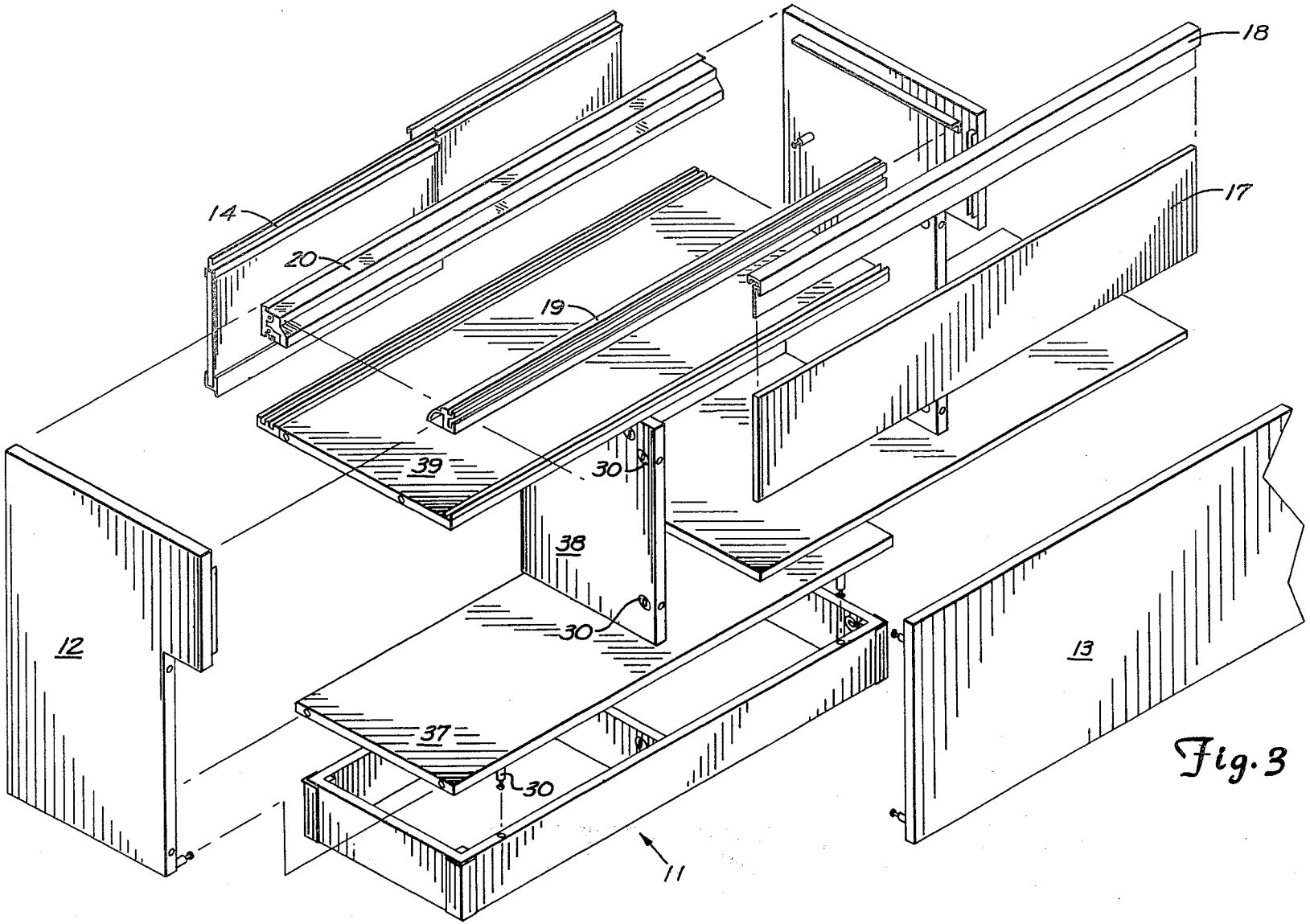
FIG. 3 is front perspective exploded view of the display case shown in FIG. 2.
Figure 6:
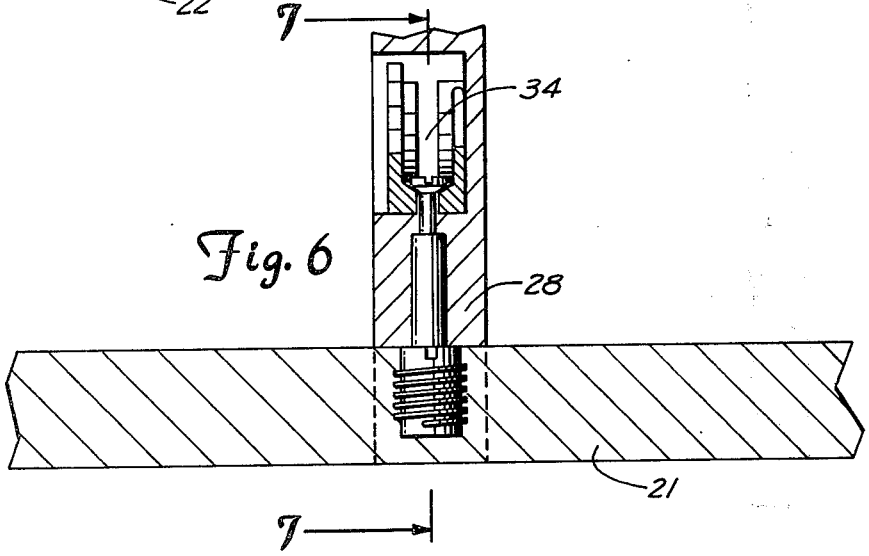
FIG. 6 is an enlarged partial cross-section taken along line 6—6 in FIG. 2.
Figure 7:
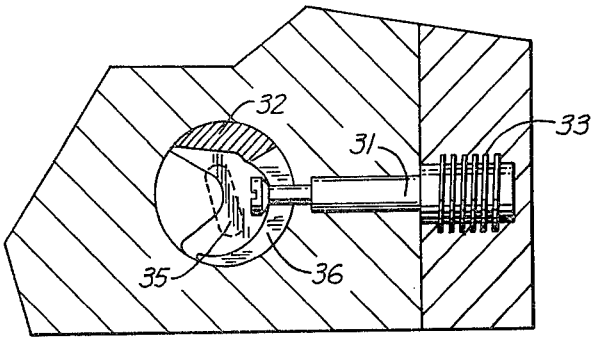
FIG. 7 is a partial cross-sectional view taken along line 7—7 in FIG. 6.

The overall construction of the case is perhaps shown best by reference to FIGS. 3, 6, and 7. One of the keys to the construction of the present invention is the use of cam lock fasteners 30 shown in enlarged detail in FIGS. 6 and 7. Each of the cam lock fasteners is comprised of two major elements, namely a bolt portion 31 and a lock portion 32. The bolt portion 31 is secured to a first member by means of threads 33. The lock portion is mounted in the second member by means of an aperature properly sized and drilled therein into which the lock portion 32 is inserted. The bolt portion and lock portion are positioned in each of the members such that when the members are brought together in a butting relationship, as illustrated in FIG. 7 the bolt portion will extend into a slot 34 provided in the lock portion. A second slot 35 is provided in the face of the lock portion for insertion of a screwdriver or other similar construction implement. Through the use of the screwdriver the lock portion 32 may be rotated in a direction so as to cause the cam surfaces 36 to engage the head of the bolt portion and draw the bolt portion into tight locking relationship with the lock portion 32. In this fashion the structural members are brought into close joining contact forming a joint which has been shown to be as close and as strong as a glued joint but without the use of any adhesive between the members. Although the locking engagement is extremely strong and tight, it nonetheless can be released by twisting the lock portion 32 in a reverse direction. In this manner the display case can be rapidly assembled and disassembled.

A number of cam lock fasteners 30 are provided at appropriate locations on all of the various flat panel members which make up the display case. The precise location and pattern of disbursement of the cam lock fasteners is largely a matter of design choice to suit a particular configuration of display case. Hence in FIG. 3 of the drawing a number of cam lock fasteners can be seen on the base portion 11, the side panels 12, the front portion 13, a floor panel 37, a divider panel 38, and a shelf panel 39.

The construction and mounting of the top glass 16 and front glass 17 will now be described with particular reference to FIGS. 3 and 4. A front rail 19 and a rear rail 20 run laterally across the width of the showcase between the side panels 12. It is preferred that the front rail 19 and rear rail 20 be extruded metal structures which allows for relative ease of manufacture where a fairly intricate shape is required. The front and rear rails are mounted to the side panels 12 by means of screws or other similar fasteners in a manner well known in the art. Channels 40 and 41 are also provided on the side panels 12 for use in supporting the top glass and front glass.

A mounting slot 42 and a locking slot 43 are formed in front rail 19. These slots are configured to mate with corresponding projections on trim member 18 in order to mount and hold the trim member 18 securely in place.

After the base portion 11, side panels 12, front portion 13, and front rail 19 and rear rail 20 have been assembled, the top glass 16 may be added by sliding it from the front to the rear and engaging it with the recesses provided in the real rail 20 and with the channels 40 on the side panels 12. Thereafter, the front glass 17 may be placed into position by dropping it vertically into the channels 41 on side panels 12 and resting it in a mounting channel 44 located on the shelf panel 39. Thereafter, both panels of glass are locked into position by the addition of trim member 18 which engages the mounting slot 42 and locking slot 43 in the front rail 19 and holds both pieces of glass firmly in place. If desired a felt material 45 or other glass cushioning material may be added at the points of contact between the metal extruded part 18 and the glass.

Should it become necessary to replace either the top glass 16 or the front glass 17 once the display case is in use, it may be very simply accomplished. To replace either panel, the trim member 18 is simply pried out of its engagement with the front rail 19 and the glass to be replaced is simply slid out of its position and replaced with a new panel. After replacement the trim member 18 is again snapped into place holding the glass. The ability to thus replace the glass panels represents a very substantial cost and time savings to the user of the display case.

A U-shaped channel is provided along the rear portion of front rail 19. If the display case is to be lighted, as most display cases of this type usually are, a pair of light brackets 46 are attached at each end of the front rail 19 by means of screw 48. The brackets include the appropriate electrical receptacle 47 for receiving a fluorescent light bulb. A light reflector 49 is mounted rearwardly of the fluorescent light tube by insertion of the mounting protrusions 51 provided on the reflector into the U-shaped channel 50. When installed the reflector 49 in cooperation with the U-shaped channel 50 form an enclosed wireway through which the electrical wiring 52 may be passed in order to keep it hidden from view. This construction makes it extremely simple to change a burned out bulb. The reflector 49 can be snapped out and a new bulb inserted easily from the back of the case.

The rear rail 20 is preferably an extruded metal piece or pieces with include channels 53 and 54 used for mounting the sliding doors 14. The mounting of the door is unique in that rather than suspending the doors on rollers from the channels 53 and 54 as is customary, in the present invention the doors are equipped with magnetic strips 57 and 58 at the bottom portion thereof. The strips are installed such as to have like poles directly opposite each other as shown in FIG. 8. In this manner the magnetic strips exert a repelling action upon one another which allows the doors to float freely on the magnetic field between the strips. The guide portions 59 and 60 ride in the channels 53 and 54, and the guides 61 and 62 ride in slots 63 and 64 provided in the basic extrusion of the door frame structure. This particular construction provides sliding doors having extremely low frictional forces and therefore requiring very minimal effort to operate. The suspension system used in the doors requires no lubrication and has almost indefinite life.

In addition to the metal extrusions used in construction of the display case and the front and top glass panels which have been described, the majority of the display case is constructed of wood or wood like products. Hence the side panels 12 the base portion 11 and front portion 13 are typically constructed either of solid wood or a wood veneer material. Pressed board materials having exterior wood veneer finishes can also be used. Because all of the cam lock fasteners 30 are positioned so as to be hidden once the display case is fully assembled the finished product has the look of very fine wood furniture with no exterior fasteners visible. Because of the unique construction the display case of the present invention lends itself extremely well to shipment from the factory to the location in an unassembled condition and with subsequent assembly on-site. Alternatively the construction lends itself equally well to mass production assembly line techniques in the factory in the event that it is desired to ship fully assembled product. The various panels and components can be stationed along a moving conveyor type assembly line and each work station can add one or more parts in sequence by simply locking them in place using the cam locks, with other stations adding the extrusions and glass and trim components. Accordingly the labor content of the finished product is remarkably reduced from that contained in the display cases of the prior art which were crafted from wood by a cabinetmaker on a one at a time basis.

While in the foregoing description the invention has been described in considerable detail for the purpose of illustration, it will be appreciated that other modifications can be made by those skilled in the art without departing from the spirit of the invention, the scope of which is to be defined in the appended claims.

I claim:

1. In a lighted showcase for displaying goods for sale such as jewelry and the like, said case including a base portion, side panels, a generally vertical back portion, a generally vertical front portion at least a portion of which is glass, and a glass top portion, the improvement comprising:

(a) a plurality of cam lock fasteners mounted in each of said base portion, side panels, and front portion, each of said cam lock fasteners being engageable upon arranging said base portion, side panels, and front portion in assembled configuration to form a rigid assembly;

(b) a front rail member mounted between said side panels at the upper front corner of said showcase, said front rail including a mounting slot and a locking slot lengthwise of the front face thereof;

(c) a front trim member engageable with said mounting slot and said locking slot of said front rail member whereby said front trim member may be removably mounted to said front rail member;

said glass top portion and said glass front portion being releasably held in place by said front trim member wherein either glass may be easily replaced in situ by removal of said front trim member.

2. The apparatus of claim 1 wherein said front rail member includes a substantially U-shaped channel integral lengthwise of the rear face thereof, said apparatus further comprising a light reflector adapted for engagement with the legs of said U-shaped channel whereby said channel and said reflector form an enclosed wireway when assembled.

3. The apparatus of claim 1 wherein said generally vertical back portion includes a door track and at least one sliding door and wherein said door track and said sliding door each are provided with magnetic strips arranged in overlying relationship and wherein the facing portion of each strip is poled oppositely to the adjacent strip whereby said door is supported upon the magnetic field between said strips.

* * * * *

UNITED STATES PATENT AND TRADEMARK OFFICE

CERTIFICATE OF CORRECTION

PATENT NO. : 4,381,876

DATED : May 3, 1983

INVENTOR(S) : Jay G. Fenwick

It is certified that error appears in the above—identified patent and that said Letters Patent is hereby corrected as shown below:

In Col. 3, line 49, delete "real" and substitute therefor the word --rear--.

Col. 6, In Claim 2, line 3 after the word "integral" insert the following --therewith and--.

Signed and Sealed this

*Twenty-first* Day of *June 1983*

[SEAL]

*Attest:*

DONALD J. QUIGG

*Attesting Officer*

*Acting Commissioner of Patents and Trademarks*